US008336967B2

(12) United States Patent
Kwon et al.

(10) Patent No.: US 8,336,967 B2
(45) Date of Patent: Dec. 25, 2012

(54) METHOD OF TAPERING BRISTLES FOR TOOTHBRUSHES, AND TOOTHBRUSH HAVING BRISTLES MANUFACTURED BY SAID METHOD

(76) Inventors: Young-Jun Kwon, Gyunggi-do (KR); Sung-Wook Kwon, Seoul (KR); Sung-Hwan Kwon, Seoul (KR)

( * ) Notice: Subject to any disclaimer, the term of this patent is extended or adjusted under 35 U.S.C. 154(b) by 1288 days.

(21) Appl. No.: 12/067,830

(22) PCT Filed: Oct. 16, 2006

(86) PCT No.: PCT/KR2006/004164

§ 371 (c)(1),
(2), (4) Date: Apr. 16, 2008

(87) PCT Pub. No.: WO2007/043848

PCT Pub. Date: Apr. 19, 2007

(65) Prior Publication Data

US 2008/0224529 A1 Sep. 18, 2008

(30) Foreign Application Priority Data

Oct. 14, 2005 (KR) ..... 10-2005-0096824

(51) Int. Cl.
*A46D 3/00* (2006.01)

(52) U.S. Cl. ..... 300/21

(58) Field of Classification Search ..... 15/167.1, 15/DIG. 5; 300/21
See application file for complete search history.

(56) References Cited

U.S. PATENT DOCUMENTS

| | | | | |
|---|---|---|---|---|
| 5,533,227 | A * | 7/1996 | Ito et al. | 15/167.1 |
| 6,021,541 | A * | 2/2000 | Mori et al. | 15/167.1 |
| 6,041,467 | A * | 3/2000 | Roberts et al. | 15/167.1 |
| 6,090,488 | A * | 7/2000 | Kweon | 428/399 |
| 6,772,467 | B1 * | 8/2004 | Weihrauch | 15/207.2 |
| 2002/0116778 | A1 * | 8/2002 | Kwon | 15/167.1 |
| 2004/0083569 | A1 * | 5/2004 | Kweon et al. | 15/167.1 |
| 2004/0103492 | A1 * | 6/2004 | Kwon et al. | 15/167.1 |

* cited by examiner

*Primary Examiner* — Randall Chin
(74) *Attorney, Agent, or Firm* — Egbert Law Offices, PLLC

(57) ABSTRACT

The present invention provides a method of tapering bristles for toothbrushes and a toothbrush having bristles manufactured using the method. One method disclosed in the present invention includes setting bristles made of polyester in a head insert, and fastening the bristles to the head insert by thermally welding portions of the bristles, protruding from a back surface of the head insert, to the head insert. The method further includes coupling the head insert to a toothbrush body and tapering ends of the bristles by immersing the bristles in a chemical. The bristles can be securely set in the toothbrush body without an anchor. Furthermore, polyester bristles, which could not be set in toothbrushes having variously shaped setting rows due to excessively high stiffness, can be set in these types of toothbrush by the toothbrush manufacturing method of the present invention.

8 Claims, 5 Drawing Sheets

[Fig. 1]
PRIOR ART
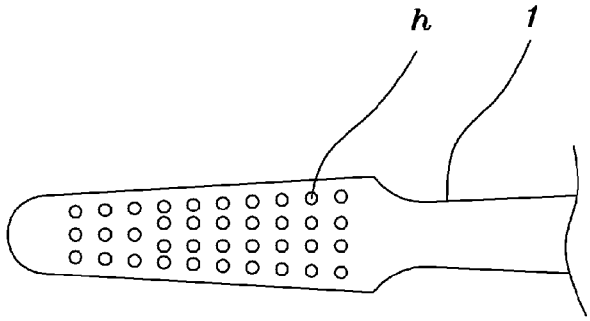
[Fig. 2]
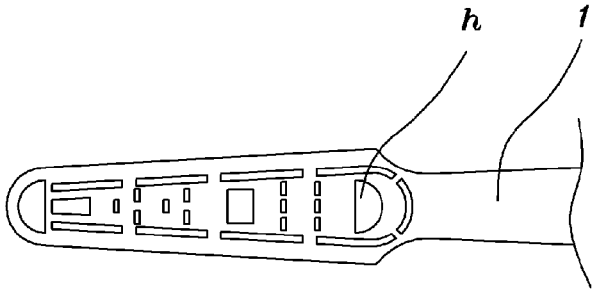
[Fig. 3]
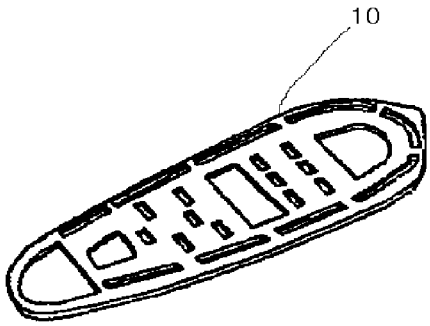

[Fig. 4]
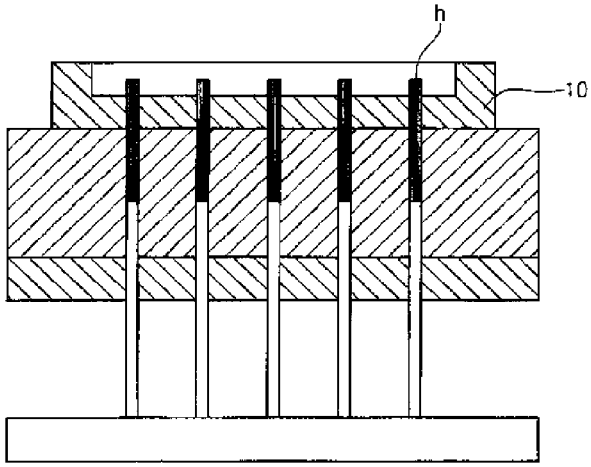
[Fig. 5]
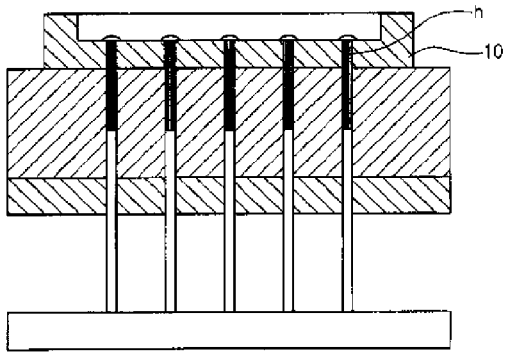
[Fig. 6]
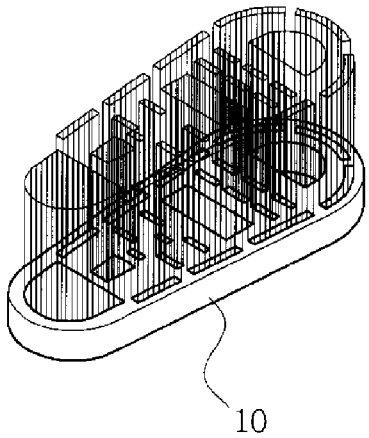

[Fig. 7]
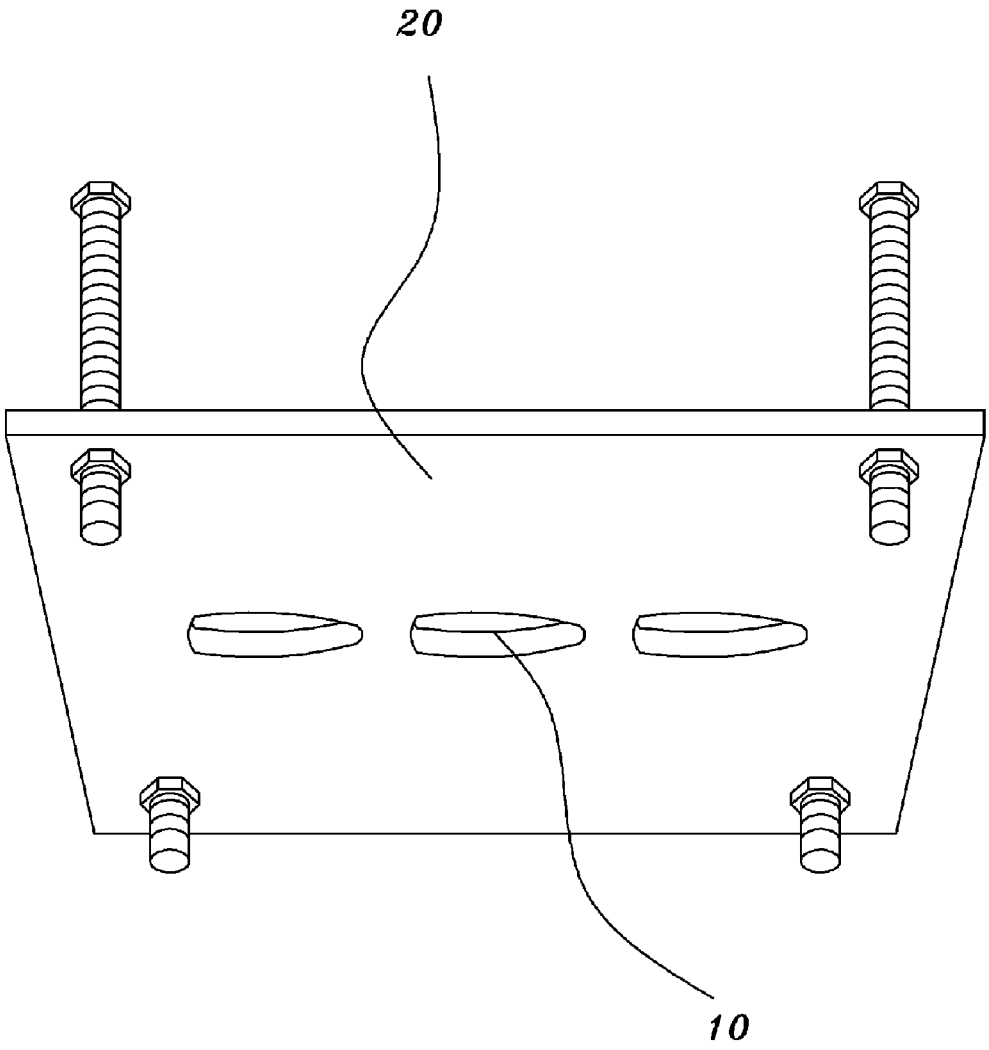

[Fig. 8]
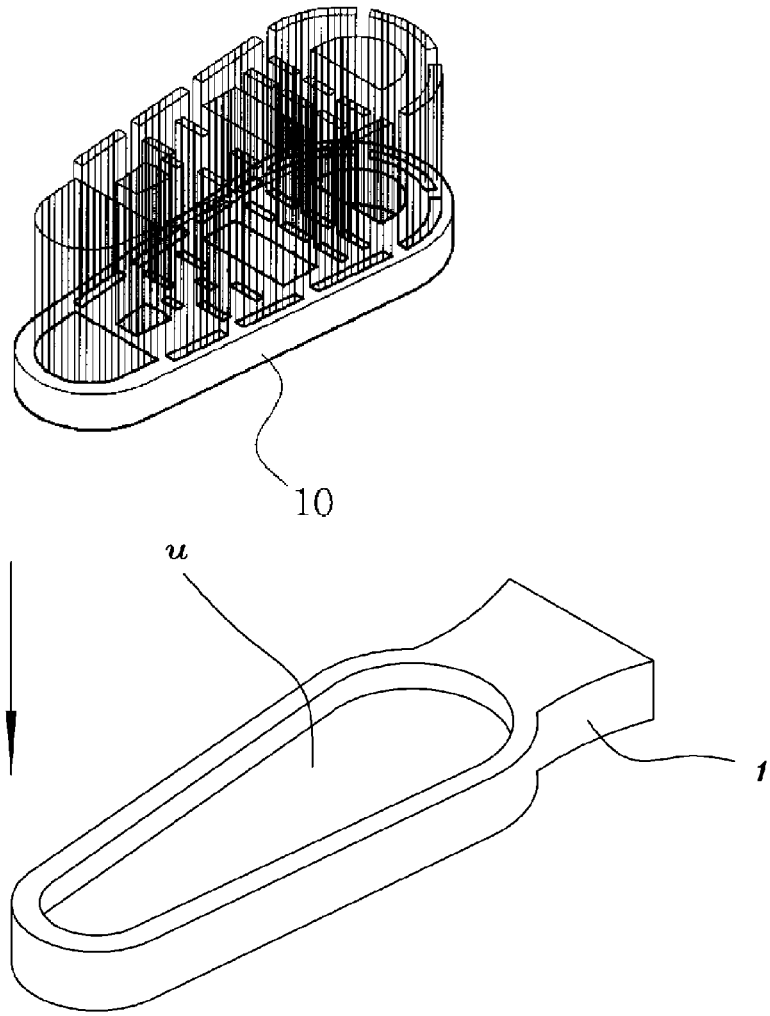
[Fig. 9]
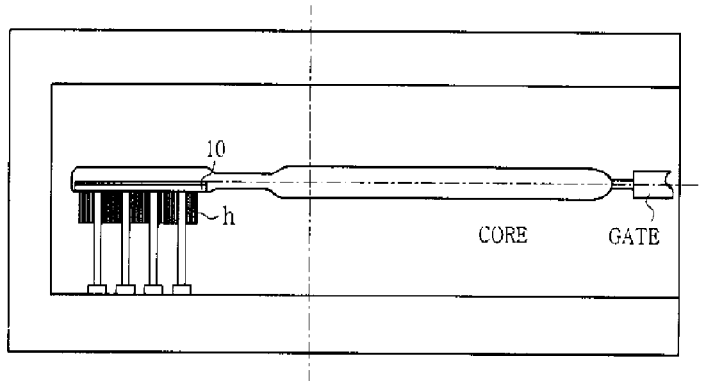

[Fig. 10]
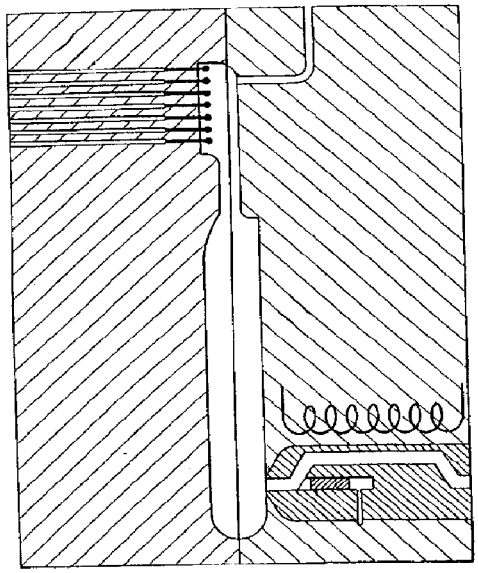
[Fig. 11]
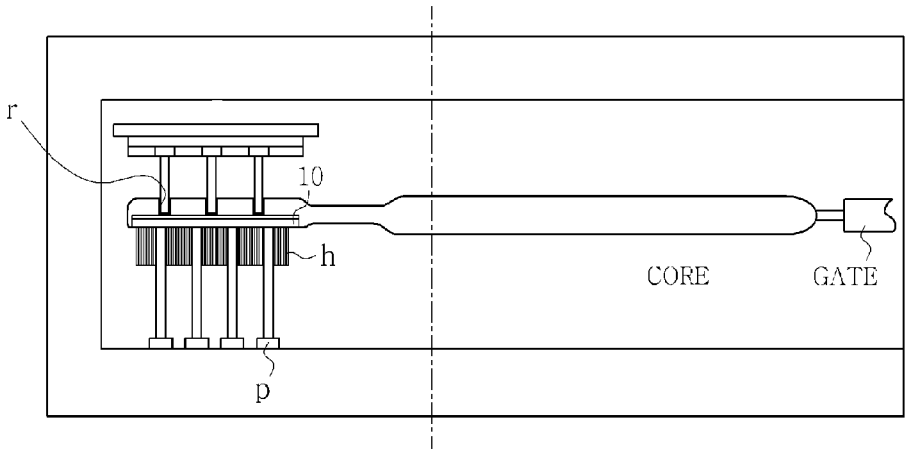

METHOD OF TAPERING BRISTLES FOR TOOTHBRUSHES, AND TOOTHBRUSH HAVING BRISTLES MANUFACTURED BY SAID METHOD

CROSS-REFERENCE TO RELATED U.S. APPLICATIONS

Not Applicable.

STATEMENT REGARDING FEDERALLY SPONSORED RESEARCH OR DEVELOPMENT

Not Applicable.

NAMES OF PARTIES TO A JOINT RESEARCH AGREEMENT

Not Applicable.

REFERENCE TO AN APPENDIX SUBMITTED ON COMPACT DISC

Not Applicable.

BACKGROUND OF THE INVENTION

1. Field of the Invention

The present invention relates, in general, to methods of tapering bristles for toothbrushes and toothbrushes having bristles manufactured using the methods. More particularly, the invention related to a method of tapering bristles for anchor-less toothbrushes and a anchor-less toothbrush which has bristles manufactured using the method.

2. Description of Related Art Including Information Disclosed Under 37 CFR 1.97 and 37 CFR 1.98.

In conventional methods of manufacturing toothbrushes having tapered bristles, a bundle of bristles, each having an end point from 0.16 to 0.2 mm in diameter, is cut to a predetermined length. Thereafter, the end points of the bristles are hydrolyzed by an alkali chemical or strong acid chemical, thus being tapered. Subsequently, the bristles are washed in water and dried. The bristles are thereafter folded in half and set in holes, formed in a head part of a toothbrush body, using anchors.

Recently, toothbrushes have followed trends, so that various bristle setting patterns have been required. Furthermore, according to an increase in the size of a bundle of bristles, it has been difficult to set bristles using a conventional bristle setting machine and to fasten bristles with an anchor.

Three methods of manufacturing an anchor-less toothbrush are as follows.

First, as a method used by Coronet Co., Ltd. of Germany, bristles are set in a mold and, thereafter, resin is injected into the mold, thus integrating the bristles with a toothbrush body.

Second, as a method used the Oral-B company of U.S.A, bristles are set in a mold brush plate and, thereafter, the head insert having bristles is placed in a mold. Subsequently, resin is injected into the mold, thus fastening the bristles to a toothbrush body.

Third, as a method used the Boucherie company of Belgium which uses a bundle of bristles having a predetermined length, unlike other companies which use a spooled filament as a bristle. Bristles are set in a head insert made of plastic and, thereafter, the head insert is seated into a head insert seat formed in a head part of a toothbrush body. Subsequently, the head insert is bonded to the toothbrush body by ultrasonic waves.

The above-mentioned methods can reliably fasten bristles to a toothbrush body without anchor. However, the equipment is very expensive, and productivity is relatively low. Moreover, because a mold, a bristle setting machine and an injection molding machine are integrated together, it is very difficult to change the setting pattern of bristles.

However, toothbrushes manufactured by the above-mentioned methods can realize various bristle setting patterns. Thus, the appearance is superior. As well, the bristle setting pattern can freely be designed to match the tooth structure of every race. Therefore, toothbrushes manufactured by the above-mentioned methods have been popular among consumers.

In the toothbrushes manufactured by the above-mentioned methods, to realize various bristle setting patterns, the volume of a bundle of bristles must become large. As a result, it is impossible to taper bristles using a conventional physical grinding method. It is well known that if bristles are tapered, flexibility is increased so that the gums of a user are protected from injury while brushing the teeth, and penetration ability of the bristles is increased, thus enhancing tooth brushing efficiency.

In conventional anchor-less toothbrushes, because a spooled filament is typically used as bristles, it is difficult to taper bristles. Therefore, instead of a method of tapering bristles, bristles made of relatively flexible nylon, for example, nylon 6, 10, and nylon 6, 12 are used, thus overcoming the above-mentioned problems. However, a nylon bristle has insufficient durability and water resistance, compared with a polyester bristle. Also, because the penetration ability of bristles, which are not tapered, is poor, tooth brushing efficiency is reduced. Furthermore, bristles made of polyester cannot be used in such a toothbrush due to excessively high stiffness.

Due to these reasons, a tapering process is required even when manufacturing toothbrushes having various setting patterns. There are bristle tapering methods as follow. As described above, there is a method wherein a bundle of bristles is cut to a predetermined length and, thereafter, the ends of the bristles are hydrolyzed by an alkali chemical or strong acid chemical, thus being tapered. Subsequently, the bristles are washed in water and dried. Thereafter, the dried bristles are folded in half and set in a toothbrush body using anchors. There is a second method wherein bristles are tapered by a physical method such as a grinding method after a bristle setting process is conducted. There is a third method wherein bristles are partially tapered by the first method and then additionally machined by the second method.

However the second method is problematic because the length of tapered portions of the bristles is relatively short, such that the bristles are not sufficiently flexible. On the other hand, the third method has the advantages of solving the problem of the method the second method and reducing the manufacturing costs. This method was proposed in Korean Patent No. 261658 which was filed by the inventor of the present invention.

In addition, as proposed in Japanese Patent No. 3022762, there is a method wherein bristles are are immersed in an alkali chemical unit just before the cores of the bristles are dissolved, thus tapering ends of the bristles, after bristles are fastened to a toothbrush body using anchors made of metal, particularly, aluminum.

However, this method is problematic because the alkali chemical penetrates to the anchors due to a capillary phenomenon during the bristle immersion process. Thus, the anchors may be undesirably dissolved. If the anchors are dissolved, the set bristles may be removed from the toothbrush body. Furthermore, in the case of a mass production process, because hydrogen gas is generated when aluminum anchors react with alkali, there is the probability of the explosion of gas due to the heat in a reaction flask. Even if the material of the anchor is changed into brass, which has been popular, dissolution may occur because zinc, added to increase the stiffness of brass, react with alkali chemical.

Due to these reasons, a product manufactured by this method has been not commercialized. In consideration of economical efficiency, only products, which are manufactured by the method in which bristles are cut to predetermined lengths, both ends of the bristles are tapered using a chemical, and the bristles are folded in half and set in toothbrush bodies using anchors, have been commercialized.

Furthermore, in a toothbrush manufactured by this method, the thickness of an end point of each bristle is 50% or more than the thickness of the end point of the bristle before chemical-treating the bristle, and the tapered portion of the bristle is only about 3 mm. Therefore, penetration ability into gaps between teeth and flexibility are limited. To solve these problems, in Korean Patent No. 261658 which was filed by the inventor of the present invention, bristles are immersed in a chemical until just before the length of the bristles is reduced, thus being partially tapered. Thereafter, the bristles are set in a toothbrush body, and the bristles are ground by a grinder such that the diameter of an end of each bristle ranges from 0.04 mm to 0.08 mm. This method can solve problems of dissolution of an anchor and of a lack of penetration ability and flexibility.

However, the bristle tapering techniques, which are disclosed in the above-mentioned prior art, such as the conventional art proposed by the inventor of the present invention, have common problems. For example, the techniques cannot be applied to a toothbrush having variously shaped setting rows.

In an effort to overcome the above-mentioned problems, another technique was proposed in Korean Patent No. 3073200 which was filed by the inventor of the present invention. Unlike prior art using double-ended needle-shaped bristles, both ends of which are tapered, this technique uses single-ended needle-shaped bristles, only one end of which is tapered. The length of each single-ended needle-shaped bristle is half the length of the double-ended needle-shaped bristle. To manufacture a toothbrush, single-ended needle-shaped bristles are received in a receiving unit and are then inserted into a head insert, in which through holes having predetermined shapes are formed, by an insert rod of a pushing plate. Thereafter, portions of bristles protruding from a back surface of the head insert are thermally welded, thus fastening the bristles to the head insert. Subsequently, the head insert having the bristles is bonded to a toothbrush body. Alternatively, after the head insert is placed in a mold, an injection molding process is conducted, thus integrating the head insert with the toothbrush body.

In this technique, the bristles are reliably fastened to the toothbrush body without an anchor. Furthermore, because only one end of each bristle is tapered, the defective proportion is markedly low, thereby the manufacturing costs are also reduced. As well, this technique can manufacture toothbrushes having variously shaped setting rows.

However, there are problems as follows. As a first problem, in this technique, a bundle of bristles is cut to a length ranging from 15 to 20 mm and chemical-treated such that the length of tapered portions of bristles ranges from 4 to 8 mm and the thickness of end points of the bristles ranges from 0.01 to 0.03 mm. Thereafter, the bristles are tied with an elastic band after washing in water and drying them. Subsequently, the bristles are set in a bristle supply machine before a bristle setting process is conducted. At this time, some bristles may be broken due to their short lengths while removing the elastic band. Thus, the loss of bristles is increased. As a second problem, because the end point of the bristles have low thickness ranging from 0.01 to 0.03 mm, when the bristles are set in through holes of the head insert by the insert rod, the ends of the bristles may be undesirably bent. As a result, heights of the set bristles are uneven. As a third problem, the surface area of tapered bristles differs from the surface area of bristles which are not tapered. Accordingly, even for a skilled worker, much labor is required when setting the bristles in the toothbrush body.

BRIEF SUMMARY OF THE INVENTION

Accordingly, the present invention has been made keeping in mind the above problems occurring in the prior art, and an object of the present invention is to provide a toothbrush which has variously shaped setting rows and tapered bristles. Another object of the present invention is to provide a toothbrush which is manufactured by a simple manufacturing process. A further object of the present invention is to provide a toothbrush which has superior water resistance ability and durability, wherein bristles easily penetrate into gaps between teeth. Yet another object of the present invention is to provide a toothbrush manufacturing method which is able to reduce the defective proportion.

Technical Solution

In one aspect, the present invention provides a toothbrush manufacturing method including: setting bristles made of polyester into holes formed in a mold; injecting resin into the mold and forming a toothbrush body such that the bristles are integrated with the toothbrush body; and tapering ends of the bristles by immersing the bristles in a chemical.

In another aspect, the present invention provides a toothbrush manufacturing method, including: setting bristles made of polyester into a head insert; fastening the bristles to the head insert by thermally welding portions of the bristles, protruding from a back surface of the head insert, to the head insert; coupling the head insert, to which the bristles are fastened, to a toothbrush body; and tapering ends of the bristles by immersing the bristles in a chemical.

In a further aspect, the present invention provides a toothbrush manufacturing method, including: setting bristles made of polyester into a head insert; fastening the bristles to the head insert by thermally welding portions of the bristles, protruding from a back surface of the head insert, to the head insert; tapering ends of the bristles by immersing the bristles in a chemical; and coupling the head insert, to which the bristles are fastened, to a toothbrush body.

In yet another aspect, the present invention provides a toothbrush, including: bristles made of polyester and having end points from 0.01 to 0.03 mm in thickness and tapered parts from 4.0 to 10.0 mm in length. The bristles are set in a head part of a toothbrush without anchor. In the present invention, polyester means polyethylene terephthalate (PET), polybutylene terephthalate (PBT) or polytrimethylene terephthalate (PTT).

Advantageous Effects

In the present invention, the bristles can be securely set in a toothbrush body without an anchor. Furthermore, polyester bristles, which could not be set in toothbrushes having variously shaped setting rows due to excessively high stiffness, can be set in these types of toothbrush using the present invention. Particularly, the present invention can efficiently manufacture a toothbrush having variously shaped setting rows without expensive equipment.

BRIEF DESCRIPTION OF THE SEVERAL VIEWS OF THE DRAWINGS

FIG. 1 is a partial schematic view showing a conventional toothbrush body to which bristles are fastened by anchor.

FIG. 2 is a schematic view showing a toothbrush body having variously shaped setting rows.

FIG. 3 is a perspective view of a head insert to be used in the present invention.

FIG. 4 is a sectional view showing a process of setting bristles into a head insert, according to the present invention.

FIG. 5 is a sectional view showing the bristles fastened to the head insert by thermally welding parts of the bristles protruding from a back surface of the head insert, according to the present invention;

FIG. 6 is a perspective view showing the head insert in which bristles are set.

FIG. 7 is a perspective view of a holding jig to be used in the present invention.

FIG. 8 is a view showing a process of fastening the head insert having bristles to a toothbrush body according to the present invention.

FIG. 9 is a schematic view showing the head insert, to which bristles are fastened, placed in a mold according to the present invention.

FIG. 10 is a sectional view showing a process of integrating bristles, set in a mold, with a toothbrush body.

FIG. 11 is a view showing a pressure relief unit placed on the back surface of the head insert according to the present invention.

DESCRIPTION OF THE ELEMENTS IN THE DRAWINGS

1: toothbrush body
10: insert head
20: holding jig
h: hole
S: receiving unit
u: head insert seat

DETAILED DESCRIPTION OF THE INVENTION

Hereinafter, the present invention will be described in detail with reference to the attached drawings.

FIG. 1 is a partial view showing a conventional toothbrush body to which bristles are fastened by anchors. In this case, bristles are set in holes (h) formed in a head part of the toothbrush body. In FIG. 1, the diameter of a bundle of bristles ranges from 1.6 to 4.0 mm. In the case larger than the above-mentioned range, it is impossible to fasten bristles to the toothbrush body using an anchor.

FIG. 2 is a schematic view showing a toothbrush body which has variously shaped setting rows and is used for a toothbrush to be manufactured by a method in which bristles are thermally welded to a head insert 10 without an anchor, or in which the bristles are set in a mold. In this method, because a bundle of bristles is fastened to the toothbrush without an anchor, the size and shape are not limited to predetermined ranges. As such, because the size and shape are not limited to predetermined ranges, variously shaped setting holes (h) can be formed in the toothbrush.

The method of the present invention can be applied both to a method in which bristles are set in the head insert 10 and, thereafter, a head insert 10 is coupled to a toothbrush body 1, and to a method in which bristles are set in a mold and, thereafter, resin is injected into the mold to form a toothbrush body 1 so that the bristles are integrated with the toothbrush body 1.

The former method will be explained herein below.

FIG. 3 shows a head insert 10 to be used in the present invention. The head insert 10 has variously shaped setting holes (h) therein. Bristles are set in the setting holes (h). The end points of the bristles to be set may have the same thickness. Alternatively, the end points of the bristles may have different thicknesses. In the case of the bristles having end points different in thickness, there is an advantage of extension of the lifespan of a toothbrush.

Furthermore, polyester bristles along with bristles made of different material, for example, along with nylon bristles, may be set in the head insert 10. In the case that bristles made of different materials are combined together, when the different bristles are immersed in a chemical to taper the bristles, some bristles may not be hydrolyzed. From this, the cleaning ability of the toothbrush may be appropriately adjusted. In detail, polyester bristles are hydrolyzed when being immersed in a chemical, thus having flexibility and penetration ability. On the other hand, bristles made of other material are not hydrolyzed, thus having high stiffness and cleaning ability. If such characteristic is appropriately adjusted, a toothbrush having desired properties can be obtained.

FIG. 4 is a sectional view showing a process of setting bristles into the head insert 10. FIG. 5 is a sectional view showing the bristles fastened to the head insert 10 by thermally welding parts of the bristles protruding from a back surface of the head insert. The bristles are set in the head insert 10 such that portions of the bristles protrude from the back surface of the head insert by 1 to 3 mm. The portions of the bristles protruding from the back surface of the insert head are fastened to the head insert 10 by thermal welding. The head insert 10 to which the bristles are fastened is shown in FIG. 6.

The bristles fastened to the head insert 10 are tapered by immersing end portions of the bristles in an acid or alkali chemical. Thereafter, the head insert 10 having the bristles is fastened to the toothbrush 1. As a preferable immersion method, as shown in FIG. 7, a holding jig 20 which holds the head insert 10 is used. The holding jig 20 has a receiving hole which has a size large enough to receive all bristles therein, but smaller than the head insert. The bristles are received in the receiving hole, and the head insert 10 is held by the holding jig 20. When using the holding jig 20 to hold the head insert 10, it is easy to immerse the bristles to desired lengths.

Here, the bristles may be completely tapered in the above-mentioned immersion process. Alternatively, after the bristles are partially tapered using the immersion process, an additional physical tapering process such as a grinding process may be executed. Regardless of a bristle tapering method, it is preferable that the bristles be tapered such that the thickness of the end points ranges from 0.01 to 0.07 mm and the length of the tapered portions ranges from 3 to 7 mm.

FIG. 8 is a view showing a process of fastening the head insert 10, to which bristles are fastened, to a toothbrush body 1. The head insert 10 is fastened to the toothbrush body 1 by inserting the head insert 10 into a head insert seat (u) formed in the toothbrush body 1.

This method has advantages as follows. Because only the relatively small head insert 10, to which bristles are fastened, is involved in a bristle tapering process, a large number of bristles is treated at one time, compared with a method in which bristles are directly set in a mold and, thereafter, the bristles are integrated with a toothbrush body by injecting resin into the mold. Furthermore, even when bristles are washed in water after conducting a process of immersing in a chemical, there is an advantage thanks to the small size. Also, because the back surface of the head insert 10 is exposed to the outside, the time required to wash the head insert 10 in water is reduced. In addition, when a defect occurs, only the head insert 10 is scrapped. The entire toothbrush is not scrapped. Consequently, the loss of products is reduced. Moreover, during the bristle tapering process, the toothbrush body is prevented from being contaminated. However, this method cannot be applied to a product to be manufactured by a method in which an entire toothbrush body 1 is simultaneously formed without a separate head part thereof.

As another method of fastening the head insert 10 to a toothbrush body 1, there is a method in which the head insert 10 having bristles is placed in the mold and, thereafter, resin is injected into the mold. In this method, the head insert can be integrated with the toothbrush body without a separate bonding process. As required, a pressure relief unit (r) having a thin plate shape may be layered on the back surface of the head insert before the resin injection process (see, FIG. 11). The pressure relief unit (r) prevents resin from flowing out along the bristles due to injection pressure. FIG. 9 is a view showing the head insert 10, to which bristles are fastened, placed in the mold.

Unlike the above-mentioned toothbrush manufacturing methods, a method, in which bristles are directly set in a mold and, thereafter, a toothbrush body is formed by injecting resin into the mold so that the bristles are integrated with the toothbrush body, is as follows.

After bristles are set in the mold in a shape shown in FIG. 10, as disclosed in Korean Patent Laid-open Publication No. 2001-00341454, parts of the bristles protruding into a cavity of the mold are thermally welded so that bristle setting holes of the mold are sealed. Thereafter, resin is injected into the cavity of the mold. At this time, the pressure of the cavity of the mold is sensed to prevent resin from leaking out along the bristles through the bristle setting holes of the mold. If the pressure of the cavity is greater than a preset value, the resin injection is temporarily stopped. When the pressure of the cavity is returned to the normal value, the resin injection resumes. By such a method, the bristles set in the mold are integrated with the toothbrush body.

The bristles of the toothbrush, which is manufactured using the above-mentioned method, are immersed in a chemical and are thus tapered in the same manner as that described for the toothbrush manufacturing method using the head insert 10.

In the toothbrush manufacturing methods described above, as required, bristles may be intentionally unevenly set in a toothbrush body such that the lengths of exposed portions of the bristles differ from each other within a range from 1 to 10 mm.

Several examples of methods of manufacturing toothbrushes are as follows.

Example 1

Bristles, which have end points of 0.19 mm in thickness and are made of PTT, are set in a mold mounted to an AFT CNC machine which was produced by Boucherie Company of Belgium. Thereafter, portions of the bristles protruding into a cavity of the mold are thermally welded, and resin is injected into the cavity of the mold, thus manufacturing a toothbrush such that the bristles are integrated with a toothbrush body.

The manufactured toothbrush is fastened to a holding jig similar to that shown in FIG. 7 and is then immersed for 17 minutes in a reaction flask in which 35% sodium hydroxide solution is maintained at 120° C. Subsequently, the toothbrush is washed in water, neutralized and dried so that the toothbrush having tapered bristles is obtained. As a result, the thicknesses of the end points of the bristles range from 0.01 to 0.02 mm. The lengths of the tapered portions of the bristles range from 5 to 7 mm.

Example 2

A head insert, to which anti-bacterial bristles, which have end points of 0.18 mm in thickness, are made of PBT, and are manufactured by Kanebo Company of Japan, is manufactured, similar to the head insert of FIG. 6, using the machine used in the first example. This head insert is treated through the same bristle tapering process as that of the first example. As a result, the thicknesses of the end points of the bristles range from 0.01 to 0.03 mm. The lengths of the tapered portions of the bristles range from 4 to 6 mm.

The manufactured head insert having bristles is seated into a bristle seat formed in a head part of a toothbrush body and is then bonded to the head part using ultrasonic waves, thus a toothbrush is obtained.

Example 3

A spooled filament, which has end points of 0.203 mm (8 mils) in thickness and is made of PBT, is continuously supplied to a weld-type toothbrush manufacturing machine which was made by Coronet Co., Ltd. of Germany, thus manufacturing a toothbrush in which bristles are set.

The manufactured toothbrush is fastened to a holding jig similar to that shown in FIG. 7 and is then immersed for 10 minutes in a reaction flask in which 95% sulfuric acid solution is maintained at 135° C., thus tapering the bristles. Subsequently, the toothbrush is washed in water, neutralized and dried. As a result, the thicknesses of the end points of the bristles range from 0.01 to 0.04 mm. The lengths of the tapered portions of the bristles range from 4 to 6 mm.

Example 4

Three kinds of bristles, which have end points of 0.152 mm, 0.178 mm and 0.203 mm in thickness and made of PBT and polyester elastomer mixed in a weight ratio of 7:3, are set in a head insert, made of plastic, by the machine used in the first example. Here, the bristles having end points of 0.152 mm in thickness are set in a central portion of the head insert. The bristles having end points of 0.178 mm in thickness are set in an intermediate portion of the head part. The bristles having end points of 0.203 mm in thickness are set in an edge portion of the head insert.

The manufactured head insert is fastened to the holding jig of FIG. 7 and is then immersed for 10 minutes in a reaction flask in which 98% sulfuric acid solution is maintained at 115° C. Subsequently, the head insert is washed in water, neutralized and dried, so that a toothbrush having tapered bristles is obtained. As a result, the thicknesses of the end points of the bristles range from 0.01 to 0.04 mm. The lengths of the tapered portions of the bristles range from 5 to 7 mm.

Example 5

Anti-bacterial bristles of Kanebo Company of Japan, which have end points of 0.18 mm in thickness and are made of PBT, and nylon bristles, which have end points of 0.20 mm in thickness, are combined in a ratio of 1:1. The time to immerse the bristles in a chemical is changed to 12 minutes. Other conditions are the same as those of the second example. In the above-mentioned conditions, a toothbrush is manufactured through the same process as that of the second example.

As a result, the thicknesses of the end points of the PBT bristles range from 0.03 to 0.05 mm, and the thicknesses of the end points of the nylon bristles are 0.20 mm.

Thereafter, the bristles are ground for 10 seconds using a drum grinder having protrusions for 10 seconds. As a result, bristles, which have end points from 0.01 to 0.02 mm in thickness and tapered parts from 3 to 5 mm in length, and bristles, which have end points from 0.10 to 0.15 mm in thickness and tapered parts from 1 to 2 mm in length, are combined together.

We claim:

1. A method of manufacturing a toothbrush, the method comprising:

setting bristles in a head insert such that one end of the bristles protrude from a back surface of the head insert, said bristles being of a polyester material;

thermally welding said one end of the bristles to said head insert;

coupling said head insert to a toothbrush body; and tapering an opposite end of the bristles after the step of setting by immersing the bristles in a chemical such that an end point at an opposite end of the bristles has a thickness of between 0.01 millimeters and 0.07 millimeters, said opposite end of the bristles having a tapered portion extending therefrom, said tapered portion having a length of between 3 millimeters and 7 millimeters.

2. A method of manufacturing a toothbrush, the method comprising:

setting bristles in a head insert such that one end of the bristles protrude from a back surface of the head insert, said bristles being of a polyester material;

thermally welding said one end of the bristles to said head insert;

placing said head insert into a cavity of a mold;

injecting resin into the cavity so as to form a toothbrush body integral with said head insert; and tapering an opposite end of the bristles after the step of setting by immersing the bristles in a chemical such that an end point at an opposite end of the bristles has a thickness of between 0.01 millimeters and 0.07 millimeters, said opposite end of the bristles having a tapered portion extending therefrom, said tapered portion having a length of between 3 millimeters and 7 millimeters.

3. The method of claim 2, further comprising:

placing a pressure relief unit on said back surface of said head insert prior to the step of injection.

4. A method of manufacturing a toothbrush, the method comprising:

setting bristles in a head insert such that one end of the bristles protrude from a back surface of the head insert, said bristles being of a polyester material;

thermally welding said one end of the bristles to said head insert;

tapering an opposite end of the bristles after the step of setting by immersing the bristles in a chemical such that an end point at an opposite end of the bristles has a thickness of between 0.01 millimeters and 0.07 millimeters, said opposite end of the bristles having a tapered portion extending therefrom, said tapered portion having a length between 3 millimeters and 7 millimeters; and coupling said head insert a toothbrush body.

5. A method of manufacturing a toothbrush comprising:

setting bristles in a mold;

placing a pressure relief unit on back surface of a head insert;

injecting resin into a cavity of sail mold so as to form a toothbrush body such that the bristles are coupled to the toothbrush body; and tapering ends of the bristles after the step of setting by immersing the bristles in a chemical such that end points of the ends of the bristles have a thickness of between 0.01 millimeters to 0.07 millimeters, said bristles having a tapered portions extending from said end points, each of said tapered portions having a length of between 3 millimeters to 7 millimeters.

6. The method of claim 5, said bristles comprising polyester bristles and non-polyester synthetic bristles combined separately and together in said mold.

7. The method of claim 5, further comprising:

physically grinding the ends of the bristles.

8. The method of claim 5, said end points having differing thicknesses.

* * * * *